US005320342A

United States Patent [19]

Houck

[11] Patent Number: 5,320,342

[45] Date of Patent: Jun. 14, 1994

[54] BASKETBALL SHOOTING TRAINING APPARATUS

[76] Inventor: Scot R. Houck, 2896 N. State Rd. 1, Cambridge City, Ind. 47327

[21] Appl. No.: 76,961

[22] Filed: Jun. 16, 1993

[51] Int. Cl.[5] ..... A63B 69/00

[52] U.S. Cl. ..... 273/1.5 A

[58] Field of Search ..... 273/1.5 A, 189 R

[56] References Cited

U.S. PATENT DOCUMENTS

| | | | |
|---|---|---|---|
| 3,101,196 | 8/1963 | Ferrara | 273/189 R X |
| 3,858,881 | 1/1975 | Hurwitz | 273/189 R X |
| 4,919,425 | 4/1990 | Wolf | 273/1.5 A |
| 5,135,217 | 8/1992 | Swain | 273/1.5 A |
| 5,228,682 | 7/1993 | Wolf | 273/1.5 A |

FOREIGN PATENT DOCUMENTS

| | | | |
|---|---|---|---|
| 8101663 | 6/1981 | PCT Int'l Appl. | 273/1.5 A |

*Primary Examiner*—Paul E. Shapiro
*Attorney, Agent, or Firm*—Robert A. Spray

[57] ABSTRACT

A basketball shooting training device, of both direct and an indirect training aid nature and benefit; i.e., it is direct in the sense that practice with it is practice for accuracy while being forced to shoot with a recommended shooting technique, and indirect in the sense that practice with it helps, and in effect practically forces, the development of that recommended shooting technique itself, thereby assuring the avoidance or breaking of a tendency or habit of using undesirable force from a one-hand shooter's other hand or from of that other hand's thumb, and thus assuring better and more consistent one-hand shooting.

The device is a sort of harness-like apparatus, having a special control member which provides a rather rigid even though yieldable restriction to the user's "other" or guide hand or its guide thumb and to its or their use during the shot. The control member is a tension member, yieldable in form, and of a moderately stiff yield character of about 1.5 inches per pound; and it has a ring at each end, one ring to hook onto the user's "other" hand's thumb, and the other ring is a connecter ring which slidably connects the control member to a carrier strip carried by a shoulder strap which passes over the shoulder of the user's "other" hand.

The ends of the shoulder strap are fixed, respectively, to frontal and dorsal portions of a torso belt, providing a firm base of the carrier strip and control member yet providing that the control member is slidable as it rearwardly moves along the carrier strip as the user is achieving a push shot effect and movement by his shooting hand, and training the shooter to use only a decreasing amount of the objectionable force input from his "other" hand as he trains with this training device.

8 Claims, 6 Drawing Sheets

BASKETBALL SHOOTING TRAINING APPARATUS

FIELD AND BACKGROUND OF THE INVENTION

The present invention relates to equipment associated with the game of basketball, and more particularly to a training aid for the improvement of a player's shooting skills and technique.

Still more particularly, the present invention relates to a training aid for the improvement of a basketball player's technique of shooting a basketball by a shot-form generally known as a "one hand push shot," such shots being an overhead shot by which the push and spin character of the ball is desirably caused predominantly by the use of only a certain one of the player's hands.

A SPECIAL AND LONG RECOGNIZED PROBLEM, AS SOLVED BY THE PRESENT INVENTION

For many decades, the use of a "one hand push shot" shooting technique has been generally recognized as providing the player with usually the best chance of basketball shooting accuracy and scoring success.

However, many youngsters, while learning the game and and acquiring shooting technique, are not strong enough to effectively achieve the distance and height of a basketball shot without a substantial use of both hands.

Other players, because of a lack of teaching or other reasons, likewise seem to have a tendency of using both hands in the pushing effort of a basketball shot.

Habits of poor or imperfect techniques in various sports efforts seem hard to break, especially in learning a special technique which may at first seem more bothersome or awkward to a player who feels he or she is already using what seems to be a more "natural" or at least workable technique.

Thus, regardless of the reason for a non-recommended "two-hand" technique, a substantial number of players are known to not have the skill and ability to achieve a recommended "one hand push shot" technique; and mere verbal coaching criticism seems often unable to achieve the desired result of maximally instilling into the player both the conscious willingness and muscular training and habit of using the long-recommended and long-preferred technique of the push of the basketball shot being predominantly by only a certain one of the player's hands.

In spite of the emphasis upon shooting accuracy and scoring ability, and in spite of the high level of sports competition, and in spite of the strong desire of players to succeed, and in spite of the need for non-star players to have good shooting success even if only for occasional shots or free throws, the lack of the development of a recommended "one hand push shot" technique has persisted as to many players, and is and for many years has been an ever-occurring new problem for young players to the sport.

THE INVENTION IN SUMMARY FORM

Providing a solution to the basketball shooting technique problem summarized herein, the present invention provides a basketball shooting training device as a training aid for developing a recommended shooting technique of a "push shot" by predominantly only a certain one of the player's hands, thus assuring better and more consistent one-hand shooting.

In a preferred form, the device is a sort of harness-like apparatus, having a special control member which provides a rather rigid even though yieldable restriction to the user's "other" or guide hand or its guide thumb and to its or their use during the shot. The control member is a tension member, yieldable in form, and of a moderately stiff yield character of about 1.5 inches per pound; and it has a ring at each end, one ring to hook onto the user's "other" hand's thumb, and the other ring is a connector ring which slidably connects the control member to a carrier strip carried by a shoulder strap which passes over the shoulder of the user's "other" hand.

The ends of the shoulder strap are fixed, respectively, to frontal and dorsal portions of a torso belt, providing a firm base of the carrier strip and control member yet providing that the control member is slidable as it rearwardly moves along the carrier strip as the user is achieving a push shot effect and movement by his shooting hand, and training the shooter to use only a decreasing amount of the objectionable force input from his "other" hand as he trains with this training device.

PRIOR TRAINING TECHNIQUES, AS FAILING TO SOLVE THE PROBLEM

As mentioned above, verbal instructions have not solved the problem for a great many basketball players, for whatever reasons, e.g., because the game is fast, and the overall circumstances of the game and portions of many practice sessions are such that the player cannot or does not sufficiently adhere fully to verbal coaching instruction, regardless of the desire of the player and the coach.

Moreover, often a verbal instruction may not be sufficiently clear to the player, and thus, regardless of willingness to learn from his coach, the player may not fully understand details of what he is doing wrong.

At least in many instances the player's guidance by verbal instructions is not in the full sense which the present invention physically teaches him, automatically and consistently and continuingly, and with a developing skill and technique.

Prior devices, as failing to solve the problem, and as showing a lack of obviousness here The inventor knows of only minor devices which have been attempted to help a player to learn a better technique for a one-hand push shot.

One device is a sort of flat disc, which is strapped to the player's non-shooting hand, but it seems to be only a bothersome and uncertain reminder of a hand not to use at all, rather than a physical guide to a small use as provided by the present invention.

Another prior art device, as to which the present inventor has heard, was apparently an attempt to provide a training device to avoid use of shooter's non-shooting hand in a one-hand push shot attempt, with a device which had a hook for hooking onto a shooter's other hand's thumb, the hook being carried by some sort of band which somehow would be fastened to the elbow or other arm-portion of the non-shooting hand. But this seems to fall quite short of the concepts and construction details of the present invention; and fails to suggest the present combination of concepts, even if improperly bolstered by concepts from various types of movement-retarding devices such as slings or movable braces of the medical field, or clothing with tied objects such as hats and scarves, connector harnessing for animal-groupings, exercise equipment of various types which permit yet load or retard a muscular motion or effort, etc.

THE INVENTION'S CONCEPTS, AS SIMILAR TO THOSE AVAILABLE IN THE PRIOR ART, EXCEPT FOR THE PRESENT CONCEPTS IN PARTICULAR

In a hindsight consideration of the present invention to determine its inventive and novel nature, it is not only conceded but emphasized that the prior art had details usable in this invention but only if the prior art had had the guidance of the present concepts of the present invention.

That is, it is emphasized that the prior art not only had the prior devices mentioned above for one-hand push shot training, but additionally several particulars which individually and accumulatively show the non-obviousness of this combination invention:

a. The prior art has long had mechanisms of various types, for centuries, which utilized tension or tensile-force-sustaining link-like members;

b. The prior art has had and used tensile members of a yieldable nature for many purposes;

c. The prior art has had, for at least many decades, various types of harness apparatus, specifically including harness-like strapping for human beings, to which other components are attached, and which would be provided a firm base by the harness strapping, and even specifically as a base for flexible or other connector members, such as ropes, strips, bands, etc., which, in their intended use, are to sustain a tensile stress and prevent a connected component from moving from harness strapping or other wrappings of human members;

d. The prior art has long had light jackets which would provide a firm base for associated components;

e. The prior art has provided various training aids for various sports, even including those which impede poor-shot technique motions; and f. The prior art has long recognized the need for training in proper one-hand push shot shooting technique.

The prior art factors such as mentioned herein are not only conceded, they are emphasized; for as to the novelty here of the invention as considered as a whole, a contrast to the prior art helps show its contrast to the present concepts, and emphasizes the advantages and the inventive significance of the present concepts as are here shown, and the nature of the concepts and their results can perhaps be easier understood.

Accordingly, although various concepts of training and other equipment, and even training equipment for one-hand basketball push shot shooting, as well as other prior art knowledge, are conceded and emphasized to have been known and used in the prior art, nevertheless, the prior art not having had the particular combination of concepts and details as here presented, and shown as a novel combination for one-hand push shot training, different from the prior art and its suggestions, even only a fair amount of realistic humility, to avoid consideration of this invention improperly by hindsight, requires the concepts and achievement here to be realistically viewed as a novel combination, inventive in nature. And especially is this a realistic consideration when viewed from the position of a person of ordinary skill in this art at the time of this invention, and without trying to reconstruct this invention from the prior art without use of hindsight toward particulars not suggested by the prior art of all relevant fields.

The prior art references fail to show or suggest the details of the present concepts; and a realistic consideration of their several differences from the present concepts may more aptly be described as teaching away from the present invention's concepts, in contrast to suggesting them, even as to a hindsight attempt to perceive suggestions from a backword look into the prior art.

BRIEF DESCRIPTION OF THE DRAWINGS

The above description of the novel and advantageous invention is of somewhat introductory and generalized form. More particular details, concepts, and features are set forth in the following and more detailed description of an illustrative embodiment, taken in conjunction with the accompanying drawings, which are of somewhat schematic and diagrammatic nature, for showing the inventive concepts.

DETAILED DESCRIPTION OF ILLUSTRATIVE EMBODIMENTS

Figure 1:
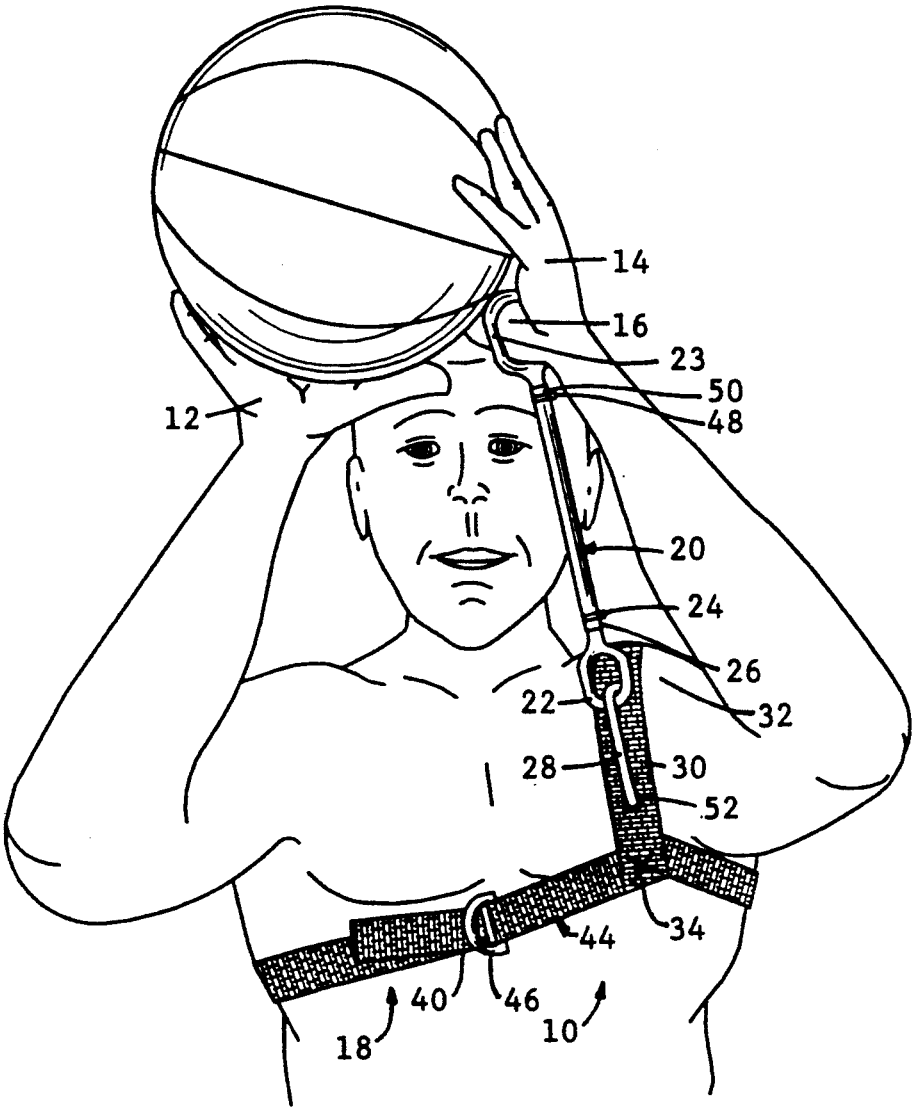
FIG. 1 is a front elevational pictorial view of a player in an intermediate portion of making "one-hand push shot" of a basketball, by his right hand, with the training device of a first embodiment of the present invention assembled onto his torso, and with its torso belt around his torso, its shoulder strap over the shoulder of his non-shooting hand, and a control member fastened to that shoulder strap and to the player's thumb of his other, i.e., non-shooting hand.
Figure 2:
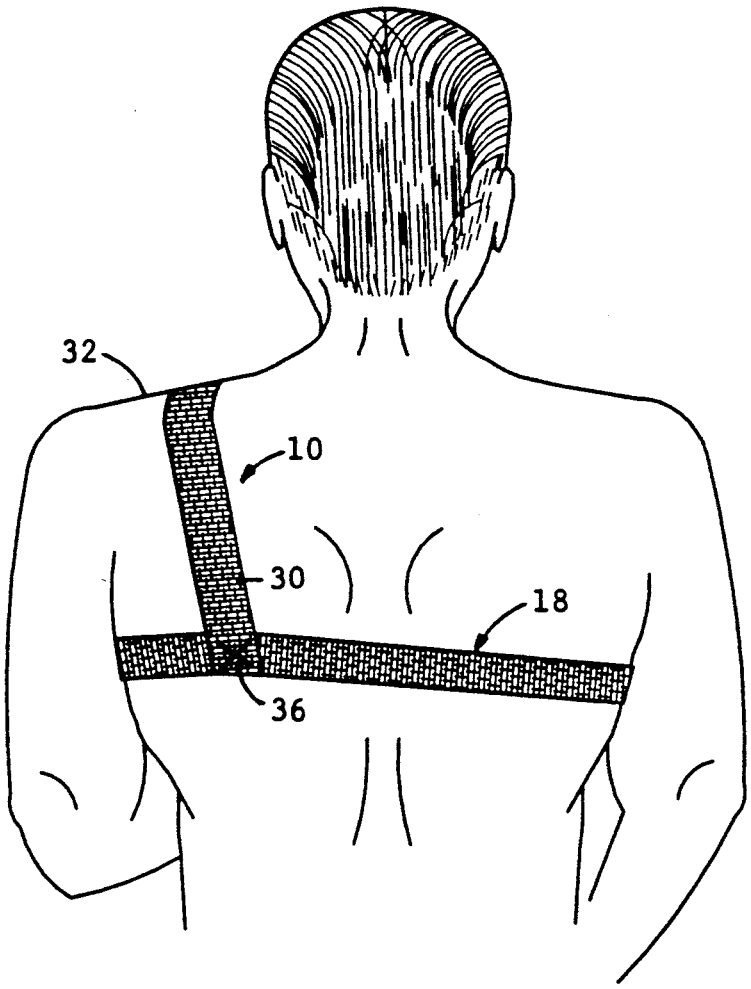
FIG. 2 is a back view of a player in a non-shooting position, showing the torso belt and the shoulder strap of the apparatus, of each embodiment, as seen from the rear of a player in an elevational view.

As shown in the drawings, the invention advantageously provides a basketball shooting training device or apparatus 10 for the teaching and learning of shooting with predominantly a chosen certain hand 12.

As herein shown, it provides the user with both direct and indirect training aid nature and benefit. The benefit is direct in the sense that practice with it is practice for accuracy while being forced to shoot with a recommended (one hand) shooting technique, and indirect in the sense that practice with it helps, and in effect practically forces, the development of that recommended (one hand) shooting technique itself.

More particularly, the device 10 and its use assures the avoidance or breaking of a tendency or habit of using undesirable force from a one-hand shooter's other hand 14 or from of that other hand's thumb 16, and thus assures better and more consistent one-hand shooting by the chosen certain hand 12.

In the drawings, the chosen certain or shooting hand 12 is the user's right hand; and the other hand 14 and its thumb 16 are the user's left hand parts whose use is being checked and forestalled by this invention, that being the imposition of significantly rigid yet yieldable restriction to the non-chosen hand 14 and its thumb 16.

More particularly, the restriction is not a direct or abrupt blockage of movement of the non-chosen hand 14 and its thumb 16, but, instead, is only in a yieldable manner such that practice with wearing the device 10 can still keep some amount of naturalness of muscular habit in the user's non-shooting hand 14, with some amount of ball guidance help, but quite in contrast to causing any significant spin or push to the ball in the shot.

That amount (although small) of naturalness for hand 14, although substantially less than the unrestricted naturalness still kept for the shooting hand 12, is in contrast, e.g., to somehow keeping the user's non-shooting hand 14 completely apart from the shot-making effort which is hereby forced to be predominantly by the chosen shooting hand 12.

Figure 3:
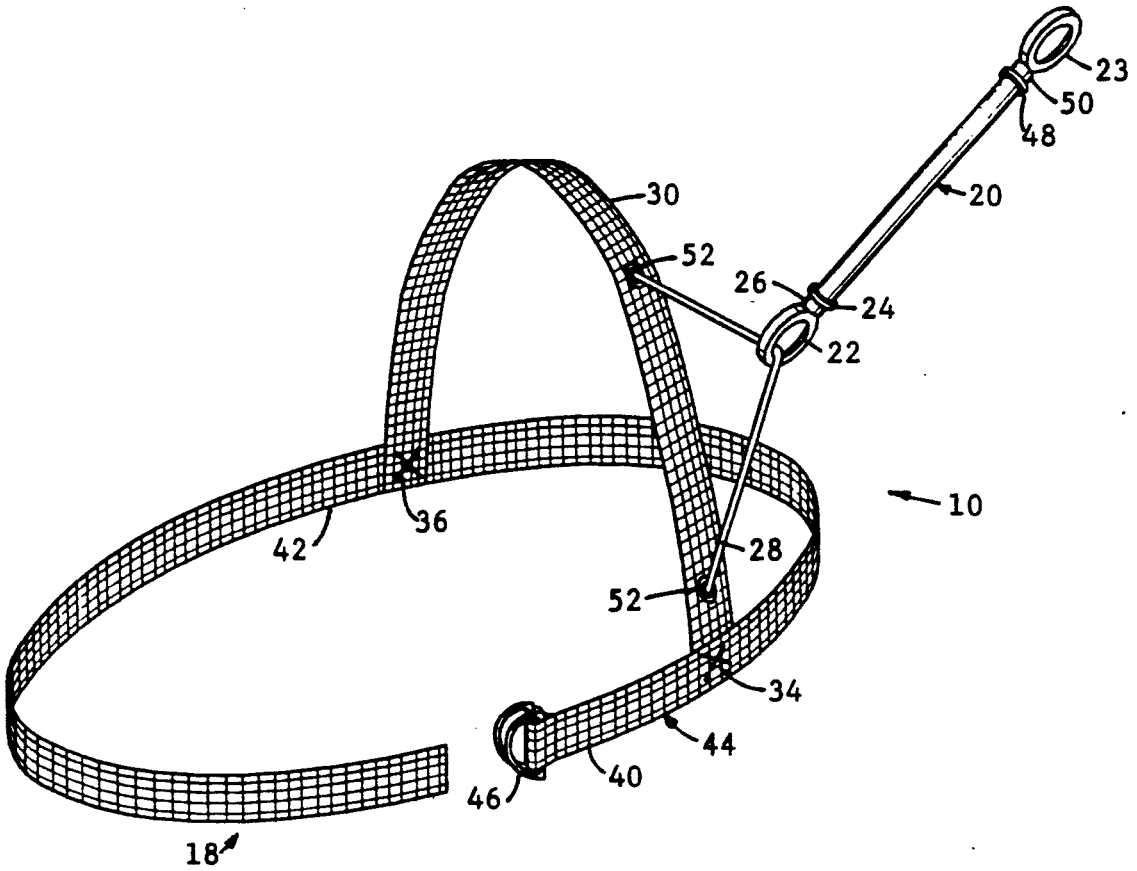
FIG. 3 is a pictorial view of the training aid apparatus of the present invention, in a spread-out illustrative form for illustrating the various components of the invention in its first embodiment.

The device 10 in the form shown appears to be a sort of harness-like apparatus having as two most conspicuous parts an overall support member 18, as a body harness, and a special control member 20 which provides a rather rigid even though yieldable restriction to the user's other or guide hand 14 or guide thumb 16 and to its or their use during the shot. The control member 20 is a tensile member of yieldable form, and of a moderately stiff yield character of about 1.5 inches per pound. As shown in the embodiment of FIGS. 1 and 3, it has a connector ring 22 and 23, respectively, at each end.

One ring 22, shown connected by an attachment clip 24 to the control member 20's end 26 most adjacent the user's torso, provides a slidable connector of the control member 20 to a rope-like carrier strip 28 carried by a shoulder strap 30 which passes over the shoulder 32 of the user's other or checked hand 14, the strap 30 and the strip 28 both lying generally in a fore-and-aft direction.

As shown, the ends of the shoulder strap 30 are fixed, as by sewing respectively at 34 and 36, to frontal 40 and dorsal 42 portions of a torso belt 44 which as shown is a torso-encircling component of the support harness 18. It is shown tightenable to the user's torso by a buckle 46, and provides a firm base of the carrier strip 28 and control member 20, yet providing that the control member 20 is slidable as it rearwardly moves along the carrier strip 28 as the user is achieving a push shot effect and movement by his shooting hand 12.

The other connector ring 23, shown connected by a connector clip 48 to the control member 20's end 50 least adjacent the user's torso, provides the hook of the user's other hand 14's thumb 16.

Figure 4:
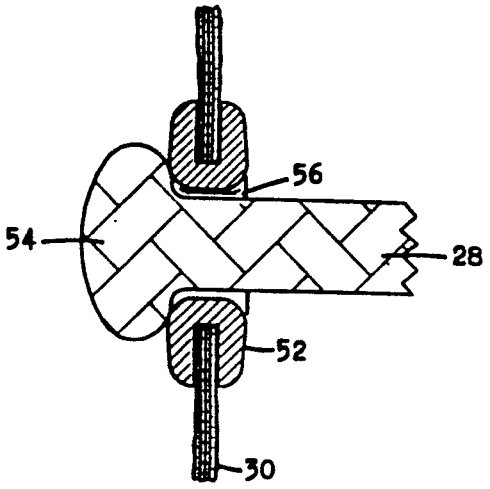
FIG. 4 is a fragmental detail view, in an enlarged scale, illustrating a connection of a connector or carrier strip to the shoulder strap, as would be seen in both embodiments.

The carrier rope 28 is connected to the shoulder strap as shown by eyelets 52; and the rope for the strip 28 is of a plastic nature, providing both long-life utility, and, as shown in FIG. 4, providing that a retainer head 54 may be provided on the end of the strip 28, after passing through the hole 56 of the eyelet 52, by a burning process.

The control member 20 of the first embodiment is shown as a piece of fairly stiff rubber tubing. However, in the second (10*a*) embodiment (see especially FIG. 5), the control member 20*a* is provided by a length of elastic band strip material 60 chosen of desired size and tension within the limits which are operative, considering the player, his size and strength, and the relation of the portions of the band 60 in use, as herein explained.

Figure 5:
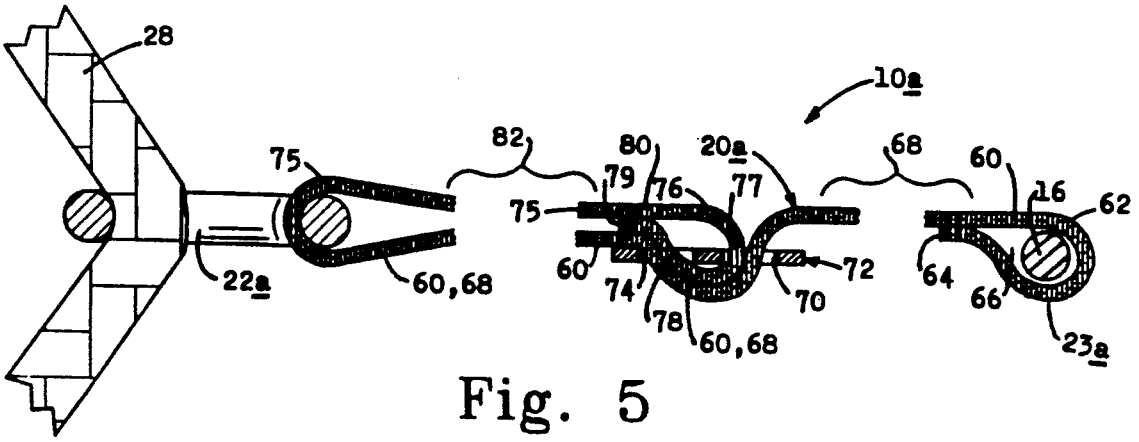
FIG. 5 is a view illustrating an elastic band control member of a second embodiment of the invention
Figure 6:
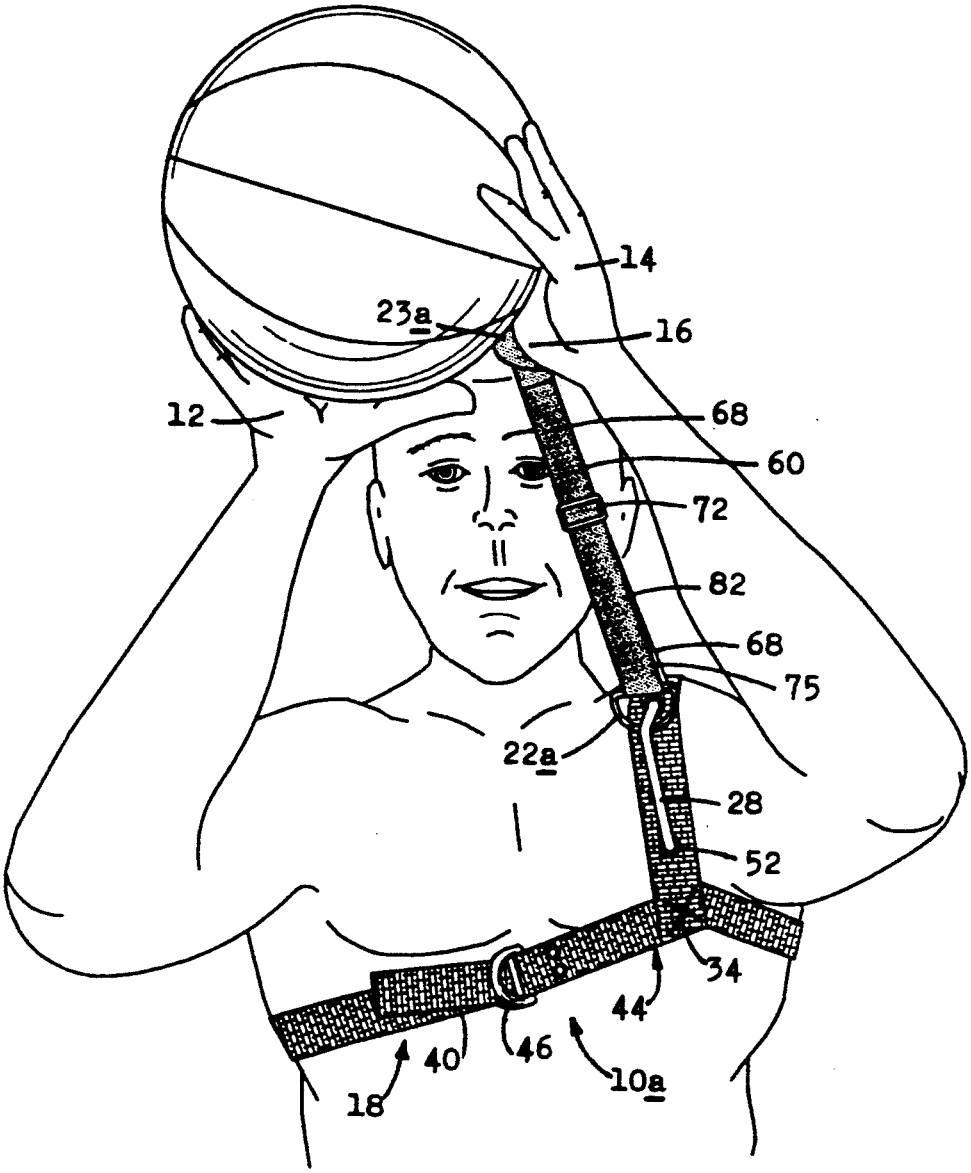
FIG. 6 is a front elevational pictorial view like FIG. 1, but showing the second embodiment of the invention with respect to its control member.
Figure 7:
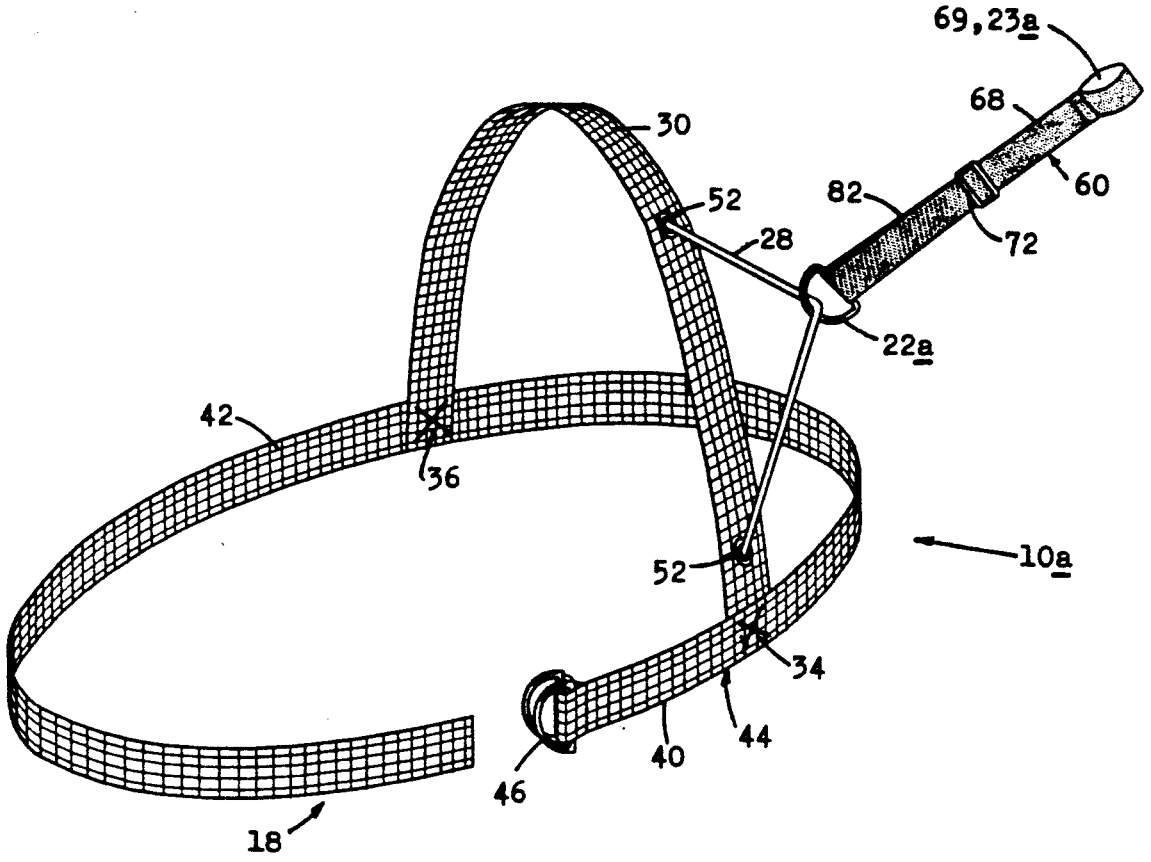
FIG. 7 is a pictorial view in spread-out illustrative form, as per FIG. 3 except that FIG. 7 shows the control strip member of the second embodiment, shown in more detail in FIGS. 5 and 6.

That is, noting the control member 20*a*, as seen from right to left in FIG. 5, it will be noted that the end 62 of the strip or band 60 is looped back over itself, and is fastened as by sewing 64 to provide that the end 62 provides a loose loop 66, a loop which itself as shown integrally provides an open ring 23*a*, a loop 66 of a size for being hooked onto the thumb 16 of the user's non-shooting hand 14, as per ring 23 of FIGS. 1 and 3.

The strip 60, leftwardly of its end 62 and its ring loop 66 (23*a*) and leftwardly of the fastener 64, continues leftwardly, towards the player's torso, by single-strand portion 68, which is then threaded through a slot 70 of a friction clip 72.

Leftwardly of the clip's slot 70, the single-strand strip-portion 68 passes through another slot 74 of the clip 72; and, leftwardly of that of that clip slot 74, the band 60 continues until it passes through a ring 22*a* which, like the ring 22 of the first embodiment, loosely embraces the carrier strip 28, the ring 22*a* and the control member 20*a* being slidable along the carrier strip 28 as in the first embodiment.

After passing through the ring 22*a*, the strip-part 75 goes toward loop 66 (ring 23*a*), thus away from the player's torso, until (at 76) it comes to the slot 70 of the clip 72, where the strip 75 (at loop 77) turns back towards the player's torso, and passes (at 78) through the slot 74. After passing through the slot 74, the end 79 of the loop 77 of the strip 60 is fastened as by sewing 80 to the strip 75's portion 76 of the strip 60 which has just entered the slot 70.

The operativity of the size-adjustment feature and the tension-adjustment feature of the control member 20*a* should be evident from the illustration in FIG. 5, as explained above. That is, the portion 68 of the strip 60 is only that of a single strand, whereas the portion 82 of the member 20*a* (68 and 75), between ring 22*a* and the fastener 80 of the clip feature 72, is of a double-strand nature, providing that the portion 82 is considerably stiffer than the portion 68. Thus, adjustment of the amount of strip 60 which is on either side of the clip 72 provides a corresponding change in the length of the total of portions 68 and 82 and the amount of tension which is respectively given by the single-strand portion of 68 and the double-strand portion (68/75) 82, those portions being, in effect, in series.

The friction between the strip 60's end loop 77 between the slots 70 and 74, against the strip 60 which extends from the loop 66, through slots 70/74, to ring 22*a*, provides adjustment retention; and the overall control member 20*a* can be thus retentively adjusted with consideration as mentioned above.

The control member 20*a* of the second embodiment, in contrast to the control member 20 of the first embodiment, provides both size-adjustment and tension-adjustment features.

CONCLUSION AND SUMMARY, AS INVENTIVE COMBINATION

It is thus seen that a basketball shooting training device, constructed and used according to the inventive concepts herein set forth, provides novel concepts of a desirable and advantageous device, yielding the advantages of an overall combination of a device which in overall combination is conceptually different from the prior art although prior art factors have been known; yet significantly this particular combination of a device in the field of basketball shooting training equipment has not been suggested by the prior art, this achievement being a substantial and advantageous departure from prior art, even though the prior art shows attempts at variations as to push shot training equipment. And particularly is the overall difference from the prior art significant when the non-obviousness is viewed by a consideration of the subject matter as a whole, as integrally incorporating a combination of features as different from the prior art, in contrast to merely those details of novelty themselves, and further in view of the prior art teaching away from the particular and inter-related concepts and features of the present invention.

In summary as to the nature of these advantageous concepts, their inventiveness is shown by novel features of concept and construction shown here, in novel and advantageous combination, not only being different from all the prior art known, but because the achievement is not what is or has been suggested to those of ordinary skill in the art, especially realistically considering this as comprising concepts which individually are similar in nature to what is well known to most persons skilled in this art for many years. No prior art has suggested the modifications of any other prior art to achieve the novel concepts here achieved, with the various features providing their own functions in the overall combination.

Accordingly, it will thus be seen from the foregoing description of the invention according to this illustrative embodiment, considered with the accompanying drawings, that the present invention provides new and useful concepts of a novel and advantageous apparatus or device having and yielding desired advantages and characteristics in formation and use, and accomplishing the intended objects, including those hereinbefore pointed out and others which are inherent in the invention.

Modifications and variations may be effected without departing from the scope of the novel concepts of the invention; accordingly, the invention is not limited to the specific embodiment, or form or arrangement of parts herein described or shown. Thus, e.g., although the invention is shown and described as to the apparatus being worn on the player's torso, the word "torso" is used in its general meaning to include the person's chest area.

Also, to avoid redundancy or alternative mentions, but with no intention of limitation, the player's chosen shooting hand is specified as his right hand, and the player's gender is specified as male.

I claim:

1. A basketball shooting training apparatus, for a user who is to shoot with predominantly only a certain one of his hands;

the apparatus providing means for restricting the use of the user's other hand and its thumb in achieving a shot, the apparatus comprising, in combination:

(a) a body-supported support means;

the support means having portions which go around the torso of the user, sufficiently tight to the user's torso, and sufficiently close to and under the shoulder of the user's said other hand, as to operatively resist upward force imposed upon the first support means during shooting as herein specified, and also a portion which goes over the shoulder of the user's said other hand; and (b) a control member which is sufficient, when assembled to the user's other hand's thumb and to the device as specified herein, to provide a significantly rigid yet yieldable restriction to the user's other hand and its thumb during a shot;

the control member being a tensile member, having connection means at each of its ends, one end being at a first end which, during assembly and use of the apparatus as herein specified, is relatively adjacent the user's torso, and its connection means is operatively connected to the support means, and the other end being a second end which, during assembly and use of the apparatus as herein specified, is relatively non-adjacent the user's torso, and its connection means is connected to the user's other hand's thumb, the control member, when connected to the apparatus' support means and to the user's other hand's thumb, providing both direct and indirect training aid nature and benefit to the user, by providing that practice with it is practice for accuracy while being forced to shoot with a recommended shooting technique, and also providing that practice with it coerces the development of that recommended predominantly one-hand shooting technique itself, thereby assuring the avoidance or breaking of a tendency or habit of using undesirable force from a one-hand shooter's other hand or from that other hand's thumb during the making of a shot;

in a combination in which the support means is provided to have a supportive strip which is secured to the support means, and which extends fore-and-aft with respect to the shoulder of the user's other hand, and the first end of the control member is operatively secured to the supportive strip.

2. The training apparatus invention as set forth in claim 1, in a combination in which the supportive strip is connected at both of its ends to the portion of the support means which goes over the shoulder of the user's said other hand.

3. The training apparatus invention as set forth in claim 2, in a combination in which the connection of the first end of the control member and the supportive strip is slidable, permitting a relatively rearward movement of of the first end of the control member along the supportive strip during the making of a shot.

4. The training apparatus invention as set forth in claim 3, in a combination in which the control member has a yield characteristic of about 1.5 inches per pound.

5. The training apparatus invention as set forth in claim 2, in a combination in which the control member has a yield characteristic of about 1.5 inches per pound.

6. The training apparatus invention as set forth in claim 1, in a combination in which the connection of the first end of the control member and the supportive strip is slidable, permitting a relatively rearward movement of of the first end of the control member along the supportive strip during the making of a shot.

7. The training apparatus invention as set forth in claim 6, in a combination in which the control member has a yield characteristic of about 1.5 inches per pound.

8. The training apparatus invention as set forth in claim 1, in a combination in which the control member has a yield characteristic of about 1.5 inches per pound.

* * * * *